US010584401B2

(12) United States Patent
Kobayashi et al.

(10) Patent No.: US 10,584,401 B2
(45) Date of Patent: Mar. 10, 2020

(54) ROLLED ALUMINUM ALLOY MATERIAL

(71) Applicant: Shimano Inc., Sakai, Osaka (JP)

(72) Inventors: Kazunori Kobayashi, Osaka (JP); Wataru Yamaguchi, Osaka (JP); Masanori Taniguchi, Osaka (JP); Toru Iwai, Osaka (JP)

(73) Assignee: Shimano Inc., Osaka (JP)

( * ) Notice: Subject to any disclaimer, the term of this patent is extended or adjusted under 35 U.S.C. 154(b) by 181 days.

(21) Appl. No.: 14/731,991

(22) Filed: Jun. 5, 2015

(65) Prior Publication Data

US 2015/0376741 A1 Dec. 31, 2015

(30) Foreign Application Priority Data

Jun. 27, 2014 (JP) ..... 2014-133014

(51) Int. Cl.

| | |
|---|---|
| ***C22C 21/08*** | (2006.01) |
| ***C22F 1/05*** | (2006.01) |
| ***C22F 1/043*** | (2006.01) |
| ***C22C 21/00*** | (2006.01) |
| ***C22F 1/047*** | (2006.01) |
| ***C22C 21/06*** | (2006.01) |
| ***C22C 21/02*** | (2006.01) |
| ***C22F 1/04*** | (2006.01) |

(52) U.S. Cl.

CPC ..... *C22C 21/08* (2013.01); *C22C 21/00* (2013.01); *C22C 21/02* (2013.01); *C22C 21/06* (2013.01); *C22F 1/04* (2013.01); *C22F 1/043* (2013.01); *C22F 1/047* (2013.01); *C22F 1/05* (2013.01)

(58) Field of Classification Search

CPC ..... C22C 21/08; C22C 21/00; C22C 21/02; C22C 21/06; C22F 1/05

See application file for complete search history.

(56) References Cited

U.S. PATENT DOCUMENTS

2018/0363113 A1* 12/2018 Matsumoto ..... C22C 21/02

FOREIGN PATENT DOCUMENTS

| | | | |
|---|---|---|---|
| DE | 198 32 489 | A1 | 1/1999 |
| DE | 102 30 710 | A1 | 7/2001 |
| DE | 103 24 453 | A1 | 1/2004 |
| DE | 10 2008 004 163 | A1 | 7/2008 |
| JP | 5-263203 | A | 10/1993 |
| JP | 2000-54054 | A | 2/2000 |
| JP | 2000-54054 | A | 2/2002 |

OTHER PUBLICATIONS

Davis, J.R. 'ASM Specialty Handbook: Aluminum and Aluminum Alloys', ASM International, 1993, p. 319-320.*

Ilschner, B .: Materials Science: Properties, Processes, Technologies 2, Improved Edition. Berlin, Heidelberg,New York, London, Paris, Tokyo, Hong Kong: Springer Verlag, 1990.

* cited by examiner

*Primary Examiner* — George Wyszomierski
*Assistant Examiner* — Janell C Morillo
(74) *Attorney, Agent, or Firm* — Global IP Counselors, LLP

(57) ABSTRACT

A rolled aluminum alloy material is provided with excellent strength and press workability and with which a poor and patchy appearance is less likely to occur after the alumite treatment. The rolled aluminum alloy material can be utilized for components of a bicycle crank. The rolled aluminum alloy material has a component composition comprising 0.6-1.4 wt % of Mg, 0.3-1.0 wt % of Si, 0.1-0.5 wt % of Cu, 0.02-0.4 wt % of Cr, and 0.1-0.6 wt % of Mn, and Al and inevitable impurities as the remainder.

4 Claims, No Drawings

ROLLED ALUMINUM ALLOY MATERIAL

CROSS-REFERENCE TO RELATED APPLICATIONS

This application claims priority under 35 U.S.C. § 119 to Japanese Patent Application No. 2014-133014, filed Jun. 27, 2014. The entire disclosure of Japanese Patent Application No. 2014-133014 is hereby incorporated herein by reference.

BACKGROUND

Field of the Invention

The present invention generally relates to a rolled aluminum alloy material used for the components of a bicycle crank. More specifically, the present invention relates to a rolled material of a 6000 series aluminum alloy.

Background Information

SUMMARY

Generally, the present disclosure is directed to various features of a rolled aluminum alloy material used for the components of a bicycle crank. In one feature, a rolled aluminum alloy material is provided which has excellent strength and press workability which a poor and patchy appearance is less likely to occur after an alumite treatment.

In view of the state of the known technology and in accordance with a first aspect of the present disclosure, a rolled aluminum alloy material is basically provided in which the elements Mg at 0.6-1.4 wt %, Si at 0.3-1.0 wt %, Cu 0.1-0.5 wt %, Cr 0.02-0.4 wt % and Mn 0.1-0.6 wt % wherein the remainder of the alloy material comprises Al and impurities.

In accordance with a second aspect of the present invention, the rolled aluminum alloy material according to the first aspect is basically provided in which the element Fe is restricted to less than or equal to 0.7 wt %.

In accordance with a third aspect of the present invention, the rolled aluminum alloy material according to any of the first and second aspects further comprises the element Zr at 0.05-0.15 wt %.

In accordance with a fourth aspect of the present invention, the rolled aluminum alloy material according to any of the first to third aspects further comprises greater than or equal to 500 dispersed particles of a size of 10-300 nm per 1 $\mu m^3$.

Also other objects, features, aspects and advantages of the disclosed rolled aluminum alloy material will become apparent to those skilled in the art from the following detailed description, which, taken in conjunction with the annexed drawings, discloses one embodiment of the rolled aluminum alloy material.

DETAILED DESCRIPTION OF EMBODIMENTS

Selected embodiments will now be explained with reference to the drawings. It will be apparent to those skilled in the bicycle field from this disclosure that the following descriptions of the embodiments are provided for illustration only and not for the purpose of limiting the invention as defined by the appended claims and their equivalents.

Conventionally, extrusion forged aluminum alloy material was used for bicycle crank parts, but the production volume of the crank parts have been increasing with the recent bicycle boom, so that crank parts that use rolled material are beginning to be evaluated with the aim to reduce costs. When manufacturing a crank part using a rolled material, if a high-strength aluminum alloy plate is press-worked as is, there are cases in which cracks, etc., are generated, and a prescribed quality cannot be obtained. For this reason, there are cases in which, first, press work is applied using a soft material (O material) as the material to obtain a crank-shaped molded part; then, in order to increase the strength of the crank product, the obtained molded part is subjected to a solution treatment, after which an age hardening treatment (T6 equivalent) is applied, and an anodization (alumite) treatment is carried out at the end.

For example, when a rolled aluminum alloy plate is used for molding, there are alloys in which the component composition is set to a specific range, and in-plane anisotropy is reduced while maintaining the strength and moldability by specifying the conditions of each step, such as a rolling and solution treatment (see Japanese Laid-Open Patent Application No. 1993-263203). Additionally, there are Al—Mg—Si alloys in which the composition, the hardness, the number of particles, and the average area of the particles of the crystallized product are controlled in order to prevent a decrease in luster after an alumite treatment, and wherein the surface is smoothed via cutting and polishing steps have been proposed (see Japanese Laid-Open Patent Publication No. 2000-54054).

However, when a conventional rolled aluminum alloy plate is used to manufacture a crank part with the above-described method, the part has a poor and patchy appearance after the anodization (alumite) treatment. This poor and patchy appearance is due to the fact that the strain that is applied to each portion of the molded product by press working differs for each portion, so that, after heating in the subsequent solution treatment, the material structure will be the same as the original worked structure or will be a structure in which recrystallization has progressed. As a result, differences are generated in the appearance of each portion after the alumite treatment, thereby making the appearance patchy. With this phenomenon, the structural form cannot be controlled after the solution treatment even if the above-described Al—Mg—Si alloy described in Japanese Laid-Open Patent Publication No. 2000-54054 is used. Therefore, this type of poor appearance cannot be sufficiently suppressed.

Thus, the main object of the present invention is to provide a rolled aluminum alloy material with excellent strength and press workability and with which a poor and patchy appearance is less likely to occur after the alumite treatment.

As a result of conducting extensive experiments in order to solve the problem described above, it has been determined that one cause of the poor and patchy appearance is the coarsening of the crystal structure due to the solution treatment. On the other hand, when forming a crank-shaped molded part by press working, strain is introduced to the rolled aluminum alloy plate. Additionally, the finding was that an excess growth of the crystal grains due to the solution treatment is likely to occur in areas where this strain is relatively small.

Therefore, the present inventors evaluated the methods to suppress the excess growth of the crystal grains and found that, by controlling the addition of transition elements and the distribution density of the precipitates, the generation of a poor and patchy appearance after the alumite treatment can be suppressed while maintaining an excellent strength and press workability. As a result, they arrived at the present invention.

That is, the rolled aluminum alloy material according to the present invention is a rolled aluminum alloy material that is used for bicycle crank parts with a component composition comprising Mg: 0.6-1.4 wt %, Si: 0.3-1.0 wt %, Cu: 0.1-0.5 wt %, Cr: 0.02-0.4 wt %, and Mn: 0.1-0.6 wt %, and Al and inevitable impurities as the remainder. The rolled aluminum alloy material of the present invention can restrict Fe to less than or equal to 0.7 wt %.

Also, the rolled aluminum alloy material of the present invention can comprise 0.05-0.15 wt % of Zr.

Meanwhile, the rolled aluminum alloy material of the present invention can comprise 500 or more dispersed particles of a size of 10-300 nm per 1 $\mu m^3$ According to the present invention, the component composition is set to a specific range, so that suppressing the generation of a poor and patchy appearance while maintaining an excellent strength and press workability for the components of a bicycle crank is possible.

Embodiments to carry out the present invention will be described in detail below. Meanwhile, the present invention is not limited to the embodiments described below.

The rolled aluminum alloy material according to the present embodiment is a 6000 series aluminum alloy and is used for bicycle crank parts. Specifically, the rolled aluminum alloy material according to the present embodiment has a component composition comprising 0.6-1.4 wt % of Mg, 0.3-1.0 wt % of Si, 0.1-0.5 wt % of Cu, 0.02-0.4 wt % of Cr and 0.1-0.6 wt % of Mn, and Al and inevitable impurities as the remainder. Additionally, the rolled aluminum alloy material of the present embodiment can be restricted to less than or equal to 0.7 wt % of Fe or can comprise 0.05-0.15 wt % of Zr, if necessary.

Mg: 0.6-1.4 wt %

Mg has the effect of increasing the strength of the rolled aluminum alloy material by solid solution strengthening. Mg also has the effect of increasing the strength of the rolled. aluminum alloy material by bonding with Si after the solution treatment and the artificial aging treatment to form Mg—Si-based precipitates. However, when the Mg content is less than 0.6 wt %, these effects cannot be sufficiently obtained. When the Mg content exceeds 1.4 wt %, the moldability declines, and cracks are generated during the press work. Thus, the Mg content in the rolled aluminum alloy material of the present embodiment is within the range of 0.6-1.4 wt %.

Si: 0.3-1.0 wt %

Si has the effect of increasing the strength of the rolled aluminum alloy material by solid solution strengthening and by bonding with Mg after the solution treatment and the artificial aging treatment to form Mg—Si-based precipitates. However, if the Si content is less than 0.3 wt %, the effect cannot be sufficiently obtained. On the other hand, when the Si content exceeds 1.0 wt %, Al—Fe—Si-based intermetallic compounds and coarse intermetallic compounds, such as Al—Fe—Mn—Si-based intermetallic compounds, are easily formed. These coarse intermetallic compounds are prone to become the starting points of cracks during molding, so that, when these compounds are present in rolled aluminum alloy material, cracking is likely to occur during press working. Thus, the Si content in the rolled aluminum alloy material of the present embodiment is from 0.3 to 1.0 wt %.

Cu: 0.1-0.5 wt %

Cu has the effect of increasing the strength of the rolled aluminum alloy material by solid solution strengthening, and by promoting the formation of Mg—Si-based precipitates after the solution treatment and the artificial aging treatment. However, when the Cu content is less than 0.1 wt %, these effects cannot be sufficiently obtained. When the Cu content exceeds 0.5 wt %, the moldability declines, and cracks are easily generated during the press work. Thus, the Cu content in the rolled aluminum alloy material of the present embodiment is from 0.1 to 0.5 wt %.

Cr: 0.02-0.4 wt %

Cr has the effect of suppressing recrystallization and of increasing the strength of the rolled aluminum alloy material, as well as of making the appearance of the manufactured crank part after the alumite treatment uniform and good. However, if the Cr content is less than 0.02 wt %, the effect cannot be sufficiently obtained. On the other hand, when the Cr content exceeds 0.4 wt %, coarse intermetallic compounds, such as Al—Mg—Cr-based intermetallic compounds are easily formed. These coarse intermetallic compounds are prone to become the starting points of cracks during molding, so that, when these compounds are present in rolled aluminum alloy material, cracking is likely to occur during press working. Additionally, the quenching sensitivity during the solution treatment becomes acute, and the strength after the aging treatment decreases. Thus, the Cr content in the rolled aluminum alloy material of the present embodiment is from 0.02 to 0.4 wt %.

Mn: 0.1-0.6 wt %

Mn has the effect of increasing the strength of the rolled aluminum alloy material by solid solution strengthening, as well as of making the appearance of the manufactured crank part after the alumite treatment uniform and good. However, if the Mn content is less than 0.1 wt %, the effect cannot be sufficiently obtained. On the other hand, when the Mn content exceeds 0.6 wt %, Al—Fe—Mn-based intermetallic compounds and coarse intermetallic compounds, such as Al—Fe—Mn—Si-based intermetallic compounds, are easily formed. These coarse intermetallic compounds are prone to become the starting points of cracks during molding, so that, when these compounds are present in rotted aluminum alloy material, cracking is likely to occur during press working. Additionally, the quenching sensitivity during the solution treatment becomes acute, and the strength after the aging treatment decreases. Thus, the Mn content in the rolled aluminum alloy material of the present embodiment is from 0.1 to 0.6 wt %.

Fe: Less Than or Equal to 0.7 wt %

Fe forms Al—Fe—Mn-based intermetallic compounds, M—Fe—Si-based intermetallic compounds, and Al—Fe—Mn—Si-based intermetallic compounds, and the like; in particular, however, when the Fe content exceeds 0.7 wt %, there is the tendency for these intermetallic compounds to become coarse or to be formed in great numbers. Since coarse intermetallic compounds are prone to become the starting points of cracks during molding, when these compounds are present in the rolled aluminum alloy material, cracking is likely to occur during press working. Thus, the Fe content is preferably restricted to less than or equal to 0.7 wt %.

Zr: 0.05-0.15 wt %

Zr has the effect of suppressing recrystallization and increasing the strength of the rolled aluminum alloy material, as well as of making the appearance of the manufactured crank part after the alumite treatment uniform and good and, thus, can be added if necessary. However, if the Zr content is less than 0.05 wt %, the effect cannot be sufficiently obtained. On the other hand, when the Zr content exceeds 0.15 wt %, coarse intermetallic compounds, such as $Al_3Zr$, are easily formed. When present in the rolled aluminum alloy material, these coarse intermetallic compounds become the starting points of cracks during molding, increasing the likelihood that cracking will occur during press working. Additionally, the quenching sensitivity during the solution treatment becomes acute, and the strength after the aging treatment decreases. Thus, when adding Zr, setting the content to be in the range of 0.05 to 0.15 wt % is preferable.

Other Added Elements

The rolled aluminum alloy material of the present embodiment can further comprise Ti in the range of 0.005 to 0.2 wt %, which thereby creates the possibility of refining the ingot. Normally, when adding Ti, an ingot refiner (Al—Ti—B) with a ratio of Ti:B=5:1 is added to the molten metal. For this reason, B is necessarily added according to the content ratio.

Remainder: Al and Inevitable Impurities

The components besides each of the components described above, namely the remainder, are Al and the inevitable impurities. Examples of inevitable impurities in the rolled aluminum alloy material of the present embodiment include Zn, V, Ga, In, Sn, Sc, Ni, C, Na, Ca, Bi, and Sr. These inevitable impurities do not interfere with the effects of the present invention if the content is less than or equal to 0.05 wt % and, thus, are permissible.

Dispersed Particles: Greater Than or Equal to 500/1 $\mu m^3$

The rolled aluminum alloy material of the present embodiment preferably comprises 500 or more, and more preferably comprises 700 or more dispersed particles of a size of 10-300 nm per 1 $\mu m^3$. As described above, a cause of the generation of a poor and patchy appearance after the alumite treatment in the manufacturing of a crank part is that a coarsening of the crystal grain structure is generated in some sites during the solution treatment. This coarsening of the crystal grain structure is likely to occur in sites where the strain that is introduced by press working is relatively small; therefore, in order to suppress this coarsening phenomenon, utilizing an effect in which fine dispersed particles suppress grain boundary migration, or the so-called pinning effect, is effective.

Here, examples of dispersed particles in the rolled aluminum alloy material include Al—Fe—Cu—Si—Mn—Cr, Al—Cu—Si—Mn—Cr, and Al—Cu—Si—Mn, and the size of each particle is 10-300 nm. Additionally, when these fine dispersed particles are distributed at 500 or more per 1 $\mu m^3$, suppressing the generation of a poor and patchy appearance on the crank part after the alumite treatment is possible.

Manufacturing Method

The rolled aluminum alloy material of the present embodiment can be manufactured by, non-limiting example, the following method, First, the aluminum alloy with the above-described component composition is melted and cast to prepare an ingot. Next, after facing this ingot, homogenizing heat treatment is carried out at a temperature that is greater than or equal to 500° C. and is less than the melting point of the aluminum alloy. Then, the ingot that has been subjected to the homogenizing heat treatment is hot rotted and made into a rolled material.

The plate thickness can be made to be thinner by further carrying out cold rolling after hot rolling The rotted plate can also be heated to 300-450° C. and subjected to annealing that is held for 0.5 hours or more and is made into a 0 material.

As described above, a specific amount of transition elements are added in the rolled aluminum alloy material of the present embodiment; therefore, suppressing the coarsening of the crystal grain structure due to the solution treatment and suppressing the occurrence of a poor and patchy appearance is possible. Additionally, the rolled aluminum alloy material of the present embodiment has excellent strength and press workability and is suitable as the components of a bicycle crank.

Embodiments

The effects of the present invention wilt be specifically described below with embodiments of the present invention, as well as with comparative examples. In the present embodiment, the embodiments and the examples of the rolled aluminum alloy material with different component compositions were prepared, and the performances thereof were evaluated.

Preparing the Rolled Aluminum Alloy Material

First, aluminum alloys with the compositions shown in Table I below were melted and cast to prepare ingots. Next, after facing the ingots, homogenizing heat treatment was carried out for 4 hours at 520° C. Then, the homogenized ingots were subjected to hot rolling, were next subjected to cold rolling, and were made into aluminum alloy plates with a plate thickness of 2.0 mm. Additionally, the rolled plates were heated to 380° C. after cold rolling, were subjected to annealing that is held at this temperature for 4 hours, and were made into a plate material for evaluation (O material).

TABLE 1

| | Composition (wt %) | | | | | | | |
|---|---|---|---|---|---|---|---|---|
| | Mg | Si | Cu | Cr | Mn | Fe | Zr | Remainder |
| Embodiment 1 | 0.7 | 0.6 | 0.3 | 0.2 | 0.4 | 0.2 | 0.0 | Al and inevitable impurities |
| Embodiment 2 | 1.0 | 0.6 | 0.3 | 0.2 | 0.4 | 0.2 | 0.0 | |
| Embodiment 3 | 1.3 | 0.6 | 0.3 | 0.2 | 0.4 | 0.2 | 0.0 | |
| Embodiment 4 | 1.0 | 0.4 | 0.3 | 0.2 | 0.4 | 0.2 | 0.0 | |
| Embodiment 5 | 1.0 | 0.9 | 0.3 | 0.2 | 0.4 | 0.2 | 0.0 | |

TABLE 1-continued

| | Composition (wt %) | | | | | | | |
|---|---|---|---|---|---|---|---|---|
| | Mg | Si | Cu | Cr | Mn | Fe | Zr | Remainder |
| Embodiment 6 | 1.0 | 0.6 | 0.15 | 0.2 | 0.4 | 0.2 | 0.0 | |
| Embodiment 7 | 1.0 | 0.6 | 0.45 | 0.2 | 0.4 | 0.2 | 0.0 | |
| Embodiment 8 | 1.0 | 0.6 | 0.3 | 0.05 | 0.4 | 0.2 | 0.0 | |
| Embodiment 9 | 1.0 | 0.6 | 0.3 | 0.35 | 0.4 | 0.2 | 0.0 | |
| Embodiment 10 | 1.0 | 0.6 | 0.3 | 0.2 | 0.2 | 0.2 | 0.0 | |
| Embodiment 11 | 1.0 | 0.6 | 0.3 | 0.2 | 0.5 | 0.2 | 0.0 | |
| Embodiment 12 | 1.0 | 0.6 | 0.3 | 0.2 | 0.4 | 0.5 | 0.0 | |
| Embodiment 13 | 1.0 | 0.6 | 0.3 | 0.2 | 0.4 | 0.2 | 0.07 | |
| Embodiment 14 | 1.0 | 0.6 | 0.3 | 0.2 | 0.4 | 0.2 | 0.12 | |
| Embodiment 15 | 0.8 | 0.7 | 0.4 | 0.25 | 0.5 | 0.2 | 0.0 | |
| Embodiment 16 | 1.1 | 0.5 | 0.2 | 0.15 | 0.35 | 0.3 | 0.0 | |
| Embodiment 17 | 1.1 | 0.5 | 0.2 | 0.15 | 0.35 | 0.3 | 0.10 | |
| Comparative Example 1 | 0.5 | 0.6 | 0.3 | 0.2 | 0.4 | 0.2 | 0.0 | |
| Comparative Example 2 | 1.6 | 0.6 | 0.3 | 0.2 | 0.4 | 0.2 | 0.0 | |
| Comparative Example 3 | 1.0 | 0.2 | 0.3 | 0.2 | 0.4 | 0.2 | 0.0 | |
| Comparative Example 4 | 1.0 | 1.2 | 0.3 | 0.2 | 0.4 | 0.2 | 0.0 | |
| Comparative Example 5 | 1.0 | 0.6 | 0.04 | 0.2 | 0.4 | 0.2 | 0.0 | |
| Comparative Example 6 | 1.0 | 0.6 | 0.6 | 0.2 | 0.4 | 0.2 | 0.0 | |
| Comparative Example 7 | 1.0 | 0.6 | 0.3 | 0.0 | 0.4 | 0.2 | 0.0 | |
| Comparative Example 8 | 1.0 | 0.6 | 0.3 | 0.5 | 0.4 | 0.2 | 0.0 | |
| Comparative Example 9 | 1.0 | 0.6 | 0.3 | 0.2 | 0.05 | 0.2 | 0.0 | |
| Comparative Example 10 | 1.0 | 0.6 | 0.3 | 0.2 | 0.7 | 0.2 | 0.0 | |
| Comparative Example 11 | 1.0 | 0.6 | 0.3 | 0.2 | 0.4 | 0.85 | 0.0 | |
| Comparative Example 12 | 1.0 | 0.6 | 0.3 | 0.2 | 0.4 | 0.2 | 0.17 | |
| Comparative Example 13 | 1.7 | 1.2 | 0.3 | 0.2 | 0.4 | 0.2 | 0.0 | |
| Comparative Example 14 | 0.3 | 0.2 | 0.9 | 0.2 | 0.4 | 0.2 | 0.0 | |
| Comparative Example 15 | 1.1 | 0.4 | 0.2 | 0.7 | 0.8 | 0.2 | 0.0 | |
| Comparative Example 16 | 0.3 | 0.2 | 0.9 | 0.2 | 0.4 | 0.2 | 0.2 | |

Evaluation of the Mechanical Properties of the O Material

JIS No. 5 test pieces were cut out from each plate material for evaluation (O material) of the embodiments and Comparative Examples, so that the rolling direction will be in the vertical direction. A tensile test was conducted on these test pieces, in accordance with JIS Z2241, using a Shimadzu Corporation (SHIMADZU CORPORATION) floor-type universal tensile testing machine AG-I to measure the tensile strength (MPa), 0.2% yield strength (MPa) and elongation (%). At this time, the cross-head speed was set to 5 mm/minute and was carried out at a constant speed until the test pieces broke.

Evaluation of Press Workability

Processing testing was conducted for each plate material for evaluation (O material) of the embodiments and Comparative Examples using a press working facility for bicycle crank parts, and the workability thereof was evaluated. As a result, those that were moldable without cracks and that did not have working defects, such as rough skin at the corner sites of the workpiece, etc., were evaluated as Pass (o) "with excellent workability;" those in which cracks were generated or rough skin and constriction were generated were evaluated as Fail (x) "with poor workability."

Evaluation of Strength After Solution/Aging Treatment

When manufacturing the components of a bicycle crank, those that are press worked to a prescribed shape are subjected to the solution treatment then to the artificial aging treatment in order to improve the strength. Therefore, in the present embodiment, a press-molded product prepared for the press workability evaluation was heated to a temperature of 520° C., was forced air cooled after retaining that state for 1 hour, then was subjected to the artificial aging treatment for 8 hours at 170° C. A JIS No. 5 test piece was cut out from a site of the molded product after the aging treatment that was as flat as possible so that the vertical direction of rolling was the longitudinal direction.

A tensile test was conducted on this test piece, in accordance with JIS Z2241, using a Shimadzu Corporation (SHIMADZU CORPORATION) floor-type universal tensile testing machine AG-I to measure the tensile strength (MPa). At this time, the cross-head speed was set to 5 min/minute and was carried out at a constant speed until the test pieces broke; three measurements were taken to calculate an average value. As a result, a determination of excellent was given when the tensile strength was greater than or equal to 300 MPa.

Evaluation of Appearance After Alumite Treatement

A workpiece, to which was applied a solution treatment and an aging treatment with the conditions described for the evaluation of strength after the solution/aging treatment described above, was used for the press worked product prepared in the above-described press workability evaluation The surface of this workpiece was polished and was further subjected to sulfuric acid &iodization to acquire the appearance of the final product (the crank part). For the evaluation, when the Amite surface appearance was uniform and good, this was considered to be a Pass (o); when spots were generated in some places on the surface or when the alumite film was not uniformly formed and became defective, this was considered to be a Fail (x).

Evaluation of the Distribution Of Dispersed Particles

The distribution of dispersed particles, such as Al—Fe—Cu—Si—Mn—Cr, Al—Cu—Si—Mn—Cr, and Al—Cu—

Si—Mn, which are present in the rolled aluminum alloy material that were annealed and made into an O material, was observed and measured using a transmission electron microscope (TEM). At this time, the thickness of the thin film of the measurement sample was adjusted to be 400 nm and was captured at an observation magnification of 50,000×. Then, using the obtained photograph of the dispersed particles, the number of dispersed particles per 1 $\mu m^3$ was determined.

The results of the above are shown collectively in Table 2 below.

TABLE 2

| | Mechanical strength of O material | | | | After solution/aging | Appearance | Number of dispersed |
|---|---|---|---|---|---|---|---|
| | Tensile strength (MPa) | Yield strength (MPa) | Elongation (%) | Press workability | Tensile strength (MPa) | after alumite treatment | particles (number/$\mu m^3$) |
| Embodiment 1 | 112 | 54 | 25.1 | ○ | 302 | ○ | 890 |
| Embodiment 2 | 145 | 62 | 23.5 | ○ | 318 | ○ | 850 |
| Embodiment 3 | 163 | 70 | 21.8 | ○ | 345 | ○ | 770 |
| Embodiment 4 | 122 | 57 | 24.7 | ○ | 303 | ○ | 730 |
| Embodiment 5 | 165 | 72 | 22.2 | ○ | 346 | ○ | 980 |
| Embodiment 6 | 131 | 59 | 24.2 | ○ | 305 | ○ | 810 |
| Embodiment 7 | 160 | 68 | 22.9 | ○ | 340 | ○ | 950 |
| Embodiment 8 | 137 | 57 | 26.3 | ○ | 329 | ○ | 730 |
| Embodiment 9 | 166 | 72 | 21.2 | ○ | 304 | ○ | 1080 |
| Embodiment 10 | 140 | 60 | 24.1 | ○ | 330 | ○ | 790 |
| Embodiment 11 | 159 | 67 | 22.0 | ○ | 310 | ○ | 1050 |
| Embodiment 12 | 142 | 60 | 22.9 | ○ | 309 | ○ | 990 |
| Embodiment 13 | 152 | 66 | 23.1 | ○ | 311 | ○ | 950 |
| Embodiment 14 | 155 | 68 | 22.4 | ○ | 308 | ○ | 1100 |
| Embodiment 15 | 134 | 58 | 23.9 | ○ | 302 | ○ | 940 |
| Embodiment 16 | 142 | 61 | 23.8 | ○ | 326 | ○ | 860 |
| Embodiment 17 | 150 | 66 | 21.8 | ○ | 320 | ○ | 800 |
| Comparative Example 1 | 103 | 49 | 25.8 | ○ | 262 | ○ | 920 |
| Comparative Example 2 | 176 | 77 | 20.3 | x | 352 | ○ | 750 |
| Comparative Example 3 | 126 | 53 | 24.5 | ○ | 294 | ○ | 730 |
| Comparative Example 4 | 170 | 74 | 20.8 | x | 328 | ○ | 1020 |
| Comparative Example 5 | 125 | 52 | 24.0 | ○ | 296 | ○ | 820 |
| Comparative Example 6 | 167 | 69 | 20.5 | x | 340 | ○ | 980 |
| Comparative Example 7 | 134 | 56 | 25.4 | ○ | 336 | x | 570 |
| Comparative Example 8 | 173 | 75 | 20.8 | x | 291 | ○ | 1320 |
| Comparative Example 9 | 125 | 51 | 24.8 | ○ | 338 | x | 590 |
| Comparative Example 10 | 148 | 69 | 20.9 | x | 295 | ○ | 1380 |
| Comparative Example 11 | 137 | 56 | 18.3 | x | 306 | ○ | 1030 |
| Comparative Example 12 | 137 | 56 | 2.1 | x | 297 | ○ | 1250 |
| Comparative Example 13 | 185 | 80 | 19.6 | x | 362 | ○ | 1150 |
| Comparative Example 14 | 135 | 58 | 19.1 | x | 286 | ○ | 990 |
| Comparative Example 15 | 131 | 53 | 18.8 | x | 285 | ○ | 1420 |
| Comparative Example 16 | 137 | 57 | 19.8 | x | 269 | ○ | 1210 |

As shown in Table 2 above, the rolled aluminum alloy material of embodiments 1 to 17 prepared in the range of the present invention were good in the mechanical properties of the O material (the tensile strength, the yield strength, and the elongation), press workability, as well as the strength after the solution/aging treatment (the tensile strength). Additionally, the rolled aluminum alloy material of embodiments 1 to 17 included 700 or more dispersed particles of a size of 10-300 nm per 1 $\mu m^3$ in the evaluation of the distribution of the dispersed particles, and the appearance after the alumite treatment was also good.

In contrast, the Mg content of the rolled aluminum alloy material of Comparative Example 1 was less than the lower limit of the range of the present invention; therefore, the tensile strength and the yield strength of the O material, as well as the tensile strength after the solution/aging treatment, were inferior, when compared to the rolled aluminum alloy material of the embodiments. On the other hand, the Mg content of the rotted aluminum alloy material of Comparative Example 2 exceeded the upper limit of the range of the present invention, so that the elongation of the O material was small, and the press workability was poor.

The Si content of the rolled aluminum alloy material of Comparative Example 3 was less than the lower limit of the range of the present invention; therefore, the tensile strength after the solution/aging treatment was inferior, when compared to the rolled aluminum alloy material of the embodiments. On the other hand, the Si content of the rolled aluminum alloy material of Comparative Example 4 exceeded the upper limit of the range of the present invention, so that the elongation of the O material was small, and the press workability was poor.

The Cu content of the rolled aluminum alloy material of Comparative Example 5 was less than the lower limit of the range of the present invention, so the tensile strength after solution/aging treatment was inferior compared to the rolled aluminum alloy material of the embodiments. On the other hand, the Cu content of the rolled aluminum alloy material of Comparative Example 6 exceeded the upper limit of the range of the present invention, so the elongation of the O material was small, and press workability was poor.

The Cr content of the rolled aluminum alloy material of Comparative Example 7 was less than the tower limit of the range of the present invention; therefore, the result of the appearance evaluation after the alumite treatment was a Fail. On the other hand, the Cr content of the rotted aluminum alloy material of Comparative Example 8 exceeded the upper limit of the range of the present invention, on that the elongation of the O material was small, the press workability was poor, and the tensile strength after the solution/aging treatment was inferior, when compared to the rolled aluminum alloy material of the embodiments.

The Mn content of the rolled aluminum alloy material of Comparative Example 9 was less than the lower limit of the range of the present invention; therefore, the result of the appearance evaluation after the alumite treatment was a Fail. On the other hand, the Mn content of the rolled aluminum alloy material of Comparative Example 10 exceeded the upper limit of the range of the present invention, so that the elongation of the O material was small, the press workability was poor, and the tensile strength after the solution/aging treatment was inferior, when compared to the rolled aluminum alloy material of the embodiments.

The Fe content of the rolled aluminum alloy material of Comparative Example 11 exceeded the upper limit of the range of the present invention, so that the elongation of the O material was small, and the press workability was poor.

The Zr content of the rolled aluminum alloy material of Comparative Example 12. exceeded the upper limit of the range of the present invention, so that the elongation of the O material was small, the press workability was poor, and the tensile strength after the solution/aging treatment was inferior, when compared to the rotted aluminum alloy material of the embodiments.

The Mg content and the Si content of the rolled aluminum alloy material of Comparative Example 13 both exceeded the upper limit of the range of the present invention, so that the elongation of the O material was small, and the press workability was poor. On the other hand, the Mg content and the Si content of the rolled aluminum alloy material of Comparative Example 14 and Comparative Example 16 were both less than the tower limit of the range of the present invention, and the Cu content exceeded the upper limit of the range of the present invention; as a result, the elongation of the O material was small, the press workability was poor, and the tensile strength after the solution/aging treatment was inferior, when compared to the rolled aluminum alloy material of the embodiments.

The Cr content and the Mn content of the rolled aluminum alloy material of Comparative Example 15 both exceeded the upper limit of the range of the present invention, so that the elongation of the O material was small, the press workability was poor, and the tensile strength after the solution/aging treatment was inferior, when compared to the rolled aluminum alloy material of the embodiments.

From the results above, a confirmation was made that the rotted aluminum alloy material of the present invention has good O material and strength after the solution/aging treatment, has an excellent press workability, and is able to suppress the generation of a poor and patchy appearance. For this reason, the rolled aluminum alloy material of the present invention can be suitably used as the components of a bicycle crank; in this case, suppressing the generation of a poor and patchy appearance while maintaining excellent strength and press workability as the components of a bicycle crank is possible.

While only selected embodiments have been chosen to illustrate the present invention, it will be apparent to those skilled in the art from this disclosure that various changes and modifications can be made herein without departing from the scope of the invention as defined in the appended claims. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A rolled aluminum alloy material for a bicycle crank component, comprising:

Mg is an amount of 0.6-1.4 wt %;

Si is an amount of 0.3-1.0 wt %;

Cu is an amount of 0.1-0.5 wt %;

Cr is an amount of 0.02-0.4 wt %;

Mn is an amount of 0.1-0.6 wt %;

Zn in an amount less than or equal to 0.05 wt %; and

Al and impurities, the rolled aluminum alloy material comprising greater than or equal to 500 dispersed particles per 1 $\mu m^3$, each of the dispersed particles having a size of 10-300 nm.

2. The rolled aluminum alloy material as recited in claim 1, wherein an amount of Fe in the rolled aluminum alloy material is less than or equal to 0.7 wt %.

3. The rolled aluminum alloy material as recited in claim 1, further comprising Zr in an amount of 0.05-0.15 wt %.

4. The rolled aluminum alloy material as recited in claim 2, further comprising Zr in an amount of 0.05-0.15 wt %.

* * * * *